US005107232A

United States Patent [19]

Evans

[11] Patent Number: 5,107,232

[45] Date of Patent: Apr. 21, 1992

[54] WIDEBAND STRIPLINE DIVIDER HAVING MEANDER INPUT LINES DISPOSED IN A TROUGH

[75] Inventor: Gary E. Evans, Hanover, Md.

[73] Assignee: Westinghouse Electric Corp., Pittsburgh, Pa.

[21] Appl. No.: 546,822

[22] Filed: Jul. 2, 1990

[51] Int. Cl.[5] ..... H01P 5/12

[52] U.S. Cl. ..... 333/128; 333/136

[58] Field of Search ..... 333/128, 127, 136, 125, 333/115-117; 343/853, 700 MS

[56] References Cited

U.S. PATENT DOCUMENTS

| | | | |
|---|---|---|---|
| 3,015,100 | 12/1961 | Rotman | 333/239 X |
| 4,079,319 | 3/1978 | Bracke | 333/109 X |
| 4,423,392 | 12/1983 | Wolfson | 333/116 |
| 4,644,360 | 2/1987 | Mead et al. | 343/700 MS |

*Primary Examiner*—Eugene R. Laroche

*Assistant Examiner*—Benny T. Lee

[57] ABSTRACT

A wide bandwidth microwave power divider is formed of a conductive enclosure having a longitudinal axis and a common wall lying therealong forming a pair of partially enclosed compartments. A pair of isolated input meander striplines having longitudinally spaced antisymmetrically disposed jogs at which power is radiated lie on opposite sides of the common wall. A plurality of output striplines one each in the vicinity of a jog are coupled to the common wall and extend outwardly of the trough. The striplines are responsive to carry the radiated signal or power from the input. A pair of parallel ground planes extend from the trough on opposite sides of the output striplines to confine the signal or power. Termination means near a proximal end of the striplines extend between the ground planes for electrically isolating the trough. A load extends between the ground planes for absorbing any imbalance in the power radiated to the striplines.

10 Claims, 4 Drawing Sheets

WIDEBAND STRIPLINE DIVIDER HAVING MEANDER INPUT LINES DISPOSED IN A TROUGH

BACKGROUND OF THE INVENTION

Field of the Invention

The invention relates to microwave circuits and in particular to a stripline microwave power divider having a wide bandwidth.

Microwave power dividers may be classified in two general categories, namely, corporate and series tapped. Corporate consists of any branching arrangement starting from a single input where the outputs are further subdivided at each division. The path length and phase length to all outputs are governed by the coupling arrangement. As a consequence, a corporate arrangement is complicated. There is also a problem with consistency or uniformity between adjacent outputs because of the inherent difficulty to render the coupling arrangements completely uniform.

In a tapped arrangement a single carrier is tapped along its length with individual outputs. Path length and phase length can be effectively preserved by appropriate spacing of the taps. These arrangements therefore tend to be simpler and more consistent than corporate power dividers.

A common series tapped divider 10, shown in FIG. 1, employs a waveguide 12 having slots 14 located in sidewall 16 and portions of the top and bottom walls 18 and 20. An input signal 22 propagates along the main waveguide 12 and radiates at each slot 14. Taps 24 in the form of slot enclosing output waveguides 26 mate with the main waveguide 12 and enclose the slots 14 to thereby provide power division. The divider is simple and a wide range of couplings is available, but it affords no isolation between outputs.

A known isolated version of the slotted divider 30 is illustrated in FIG. 2. In the arrangement, the input 32 is divided between a pair of main slotted waveguides 34 by a four port coupler 36, output ports 38 of which feed the main waveguides 34. One input 40 of the coupler 36 carries the input signal 41 and the isolated port 42 of the coupler 36 is terminated. Terminal ends 44 of the main waveguidse 34 are appropriately terminated. The main waveguides 34 have adjacent pairs of slots 46 enclosed by corresponding pairs of proximate output waveguides 48. The split input signal 41 from each main waveguides 34 is recombined in the output coupler 50. A terminal output waveguide 52 connected to a corresponding coupler 50 carries the divided power signal to the output 53. Terminations 54 are provided for the unused port of each coupler 50. The arrangement in FIG. 2 is complex, heavy and expensive to fabricate and the bandwidth is limited.

SUMMARY OF THE INVENTION

The present invention comprises a simplified, lightweight, wide bandwidth microwave power divider overcoming some of the limitations in the described prior arrangements. In an exemplary embodiment, the invention comprises a conductive trough forming an enclosure having a longitudinal axis and a common wall lying therealong forming a pair of partially enclosed compartments. At least one, but preferably a pair of isolated input meander striplines having longitudinally spaced antisymmetrically opposite disposed jogs, at which power is radiated, lie on opposite sides of the common wall. A plurality of output striplines coupled to the common wall extend outwardly of the trough one each in the vicinity of a jog and are responsive to carry the radiated power from the input. A pair of parallel ground planes extend from the trough on opposite sides of the output striplines. Shunt connection means near a proximal end of the stripline extend between the ground planes for electrically isolating the trough from the output. Load means extend between the ground planes for absorbing any imbalance in the power radiated to the striplines.

DESCRIPTION OF THE INVENTION

Figure 4A:
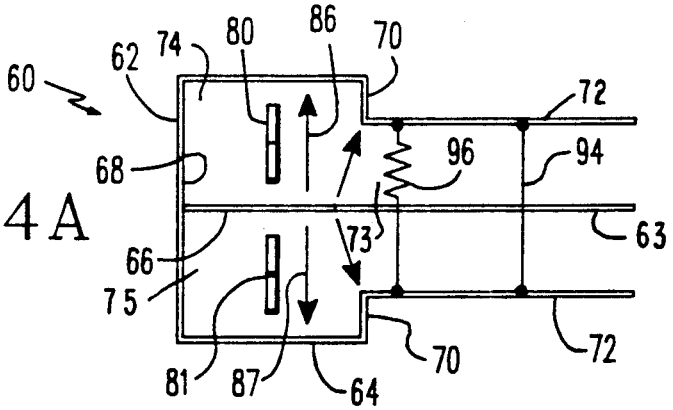
FIGS. 4A—4B are cross-sectional views of the power divider of FIG. 3 illustrating balanced and unbalanced fields, respectively, and electrical terminations.
Figure 4B:
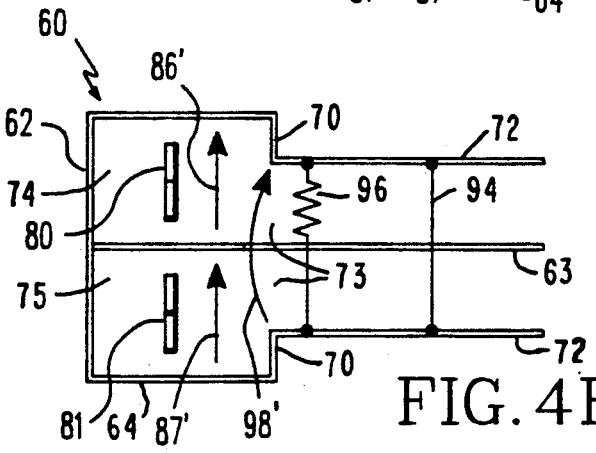
Figure 3:
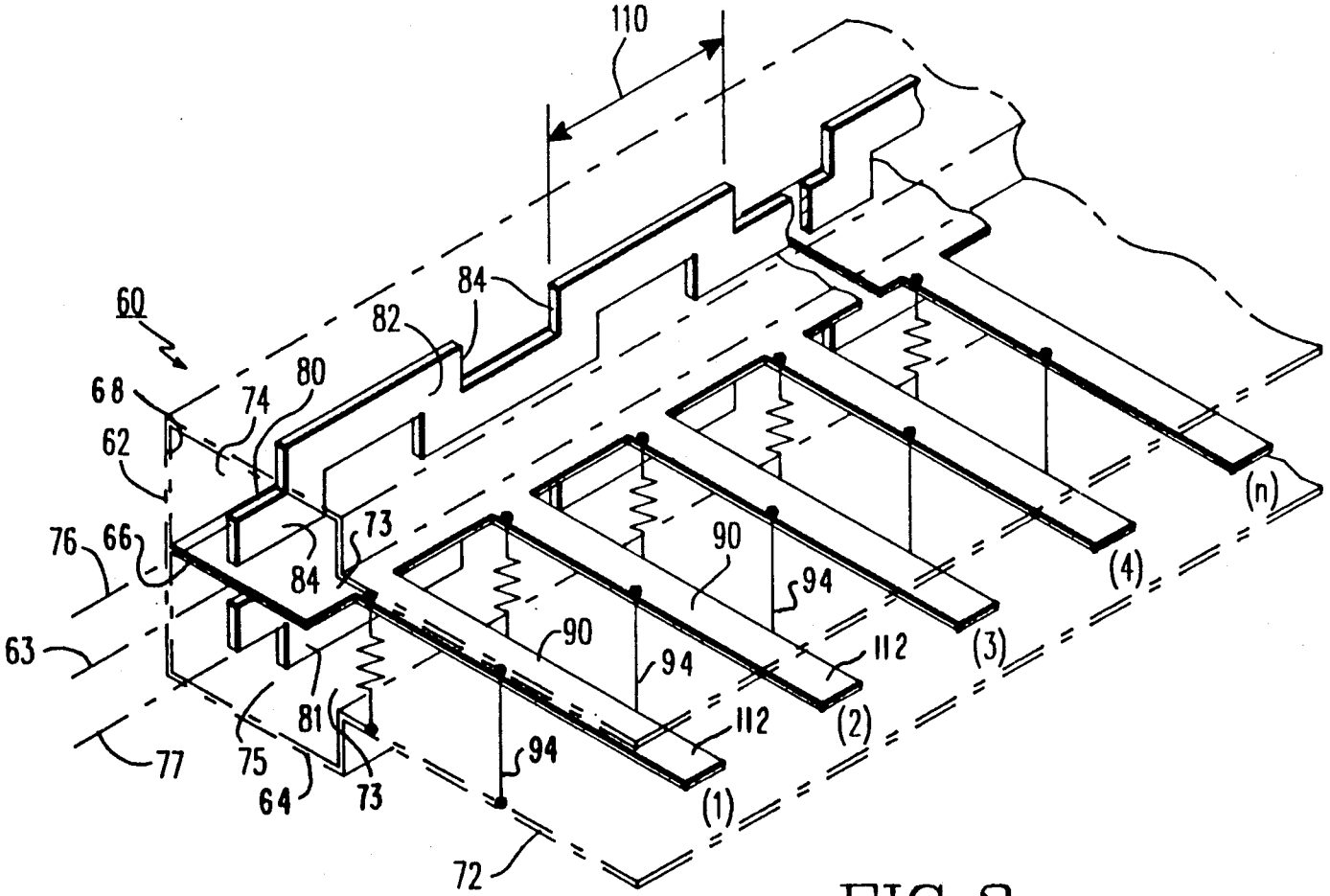
FIG. 3 is a partially fragmented perspective view of an isolated stripline power divider according to the present invention.
Figure 5:
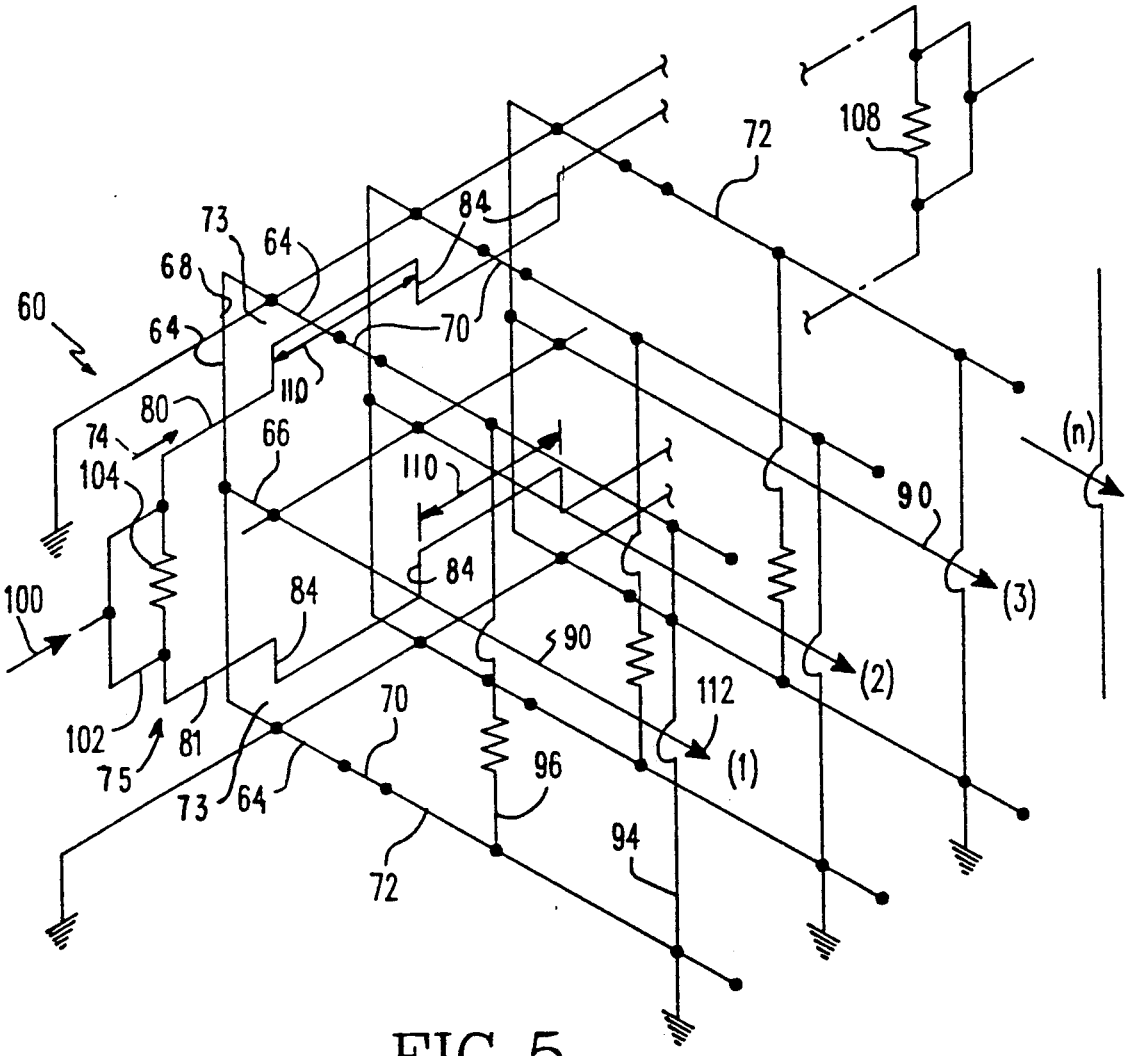
FIG. 5 is a schematic diagram of the power divider illustrated in FIG. 3.

In accordance with the invention a stripline power divider 60 is more fully set forth in the accompanying specification and is illustrated in FIGS. 3-5. As best seen in FIG. 3, the power divider 60 comprising an elongated conductive trough or housing 62, having a central axis 63, is formed of opposed outer-walls 64, intermediate central wall 66 located between the opposed walls 64 on the trough axis 63 and interconnecting wall 68 electrically connecting the opposed outer-walls 64 and the central wall 66. A pair of partial stepped walls 70 extend one each from the opposed walls 64, as shown. A pair of ground planes 72 extend laterally away from the stepped walls 70. The arrangement of walls illustrated forms a pair of compartments 74 and 75 each having a corresponding longitudinal axis 76 and 77. Preferably, the axis 63 of the trough 62 and the axes 76, 77 of the compartments 74, 75 lie in a common plane. A pair of spaced apart meander input striplines 80 and 81 are provided. The stripline 80 is located in the compartment 74 along the corresponding axis 76 and the stripline 81 is located in the compartment 75 along the axis 77. In the invention, because isolation is desired, the striplines 80, 81 are paired. However, it may be desirable to form a simplified divider with one stripline.

The striplines 80 and 81 are formed of flattened elongated conductors having lengthwise portions 82 and transverse interconnecting jogs 84 symmetrically formed therealong at the spaced locations, as shown. The striplines 80, 81 lie in the plane formed by the axes 63, 76 and 77. The lengthwise portions 82 and the jogs 84 of the striplines 80, 81 are aligned one above the other. Further, the striplines 80 and 81 are arranged in antisymmetric configuration, that is, the stripline 80 extends lengthwise below the axis 76 and jogs upwardly and then extends lengthwise above the axis 76 and then jogs down in an up down up arrangement. The stripline 81 is arranged so that it is initially above axis 77 and jogs down in a down up down arrangement as illustrated. The antisymmetric configuration results in opposed balanced fields 86 and 87 as shown in FIG. 4A.

A plurality of output striplines 90 which may be attached to or formed integrally with the central wall 66 extend in a direction perpendicular to the input stripline axes 76, 77. Each output stripline 90 is located in alignment with each aligned pair of antisymmetric jogs 84. The output striplines 90 and the opposed ground planes 72 carry and confine the signal produced at each jog 84. As illustrated in FIG. 4A, the gap 73 in the stepped side walls 70, separating the ground planes 72 provides clearance for the output stripline 90.

In order to provide good electrical isolation between the input trough 62 and the output stripline 90, one or more shunts 94 are provided which electrically connect the ground planes 72 in the vicinity of the gap 73. Accordingly, the opposed walls 64, the end wall 68, the stepped walls 70 and the shunts 94 electrically isolate the input trough 62 from the output including the ground planes 72 and the output striplines 90.

Field imbalance is handled by one or more field absorbers or load resistors 96 provided between the ground planes 72. Although in the preferred embodiment it is anticipated that the respective fields 86 and 87 (FIG. 4A) produced by the upper and lower striplines 80, 81 will always be opposed and therefore in balance, it is possible that the field vectors 86', 87'(FIG. 4B) may coincide and reinforce each other, thereby causing a field imbalance illustrated by the vector 98'. The field absorber 96 is therefore provided to absorb such imbalance.

An electrical schematic diagram of the stripline power divider is illustrated in FIG. 5. The conductors illustrated are labeled with the same reference numbers as the corresponding conductive wall portions illustrated in FIGS. 3 and 4. An input signal 100 is provided to a split "T" coupler 102 which is terminated by load resistor 104. The striplines 80, 81 are connected to opposite sides of the load 104 and proceed an antisymmetric fashion along their respective axis to a termination 108 at the terminal end. The ground planes 72 are interconnected serially with the trough structure 62 including the stepped walls 70, opposed walls 74, interconnecting walls 68 and the central wall 66. The output striplines 90 are connected to the central wall 66 in the vicinity of the antisymmetric jogs 84. The shunts 94 and the field absorber load resistors 96 which couple the upper and lower ground planes 72 together are also illustrated.

Figure 1:
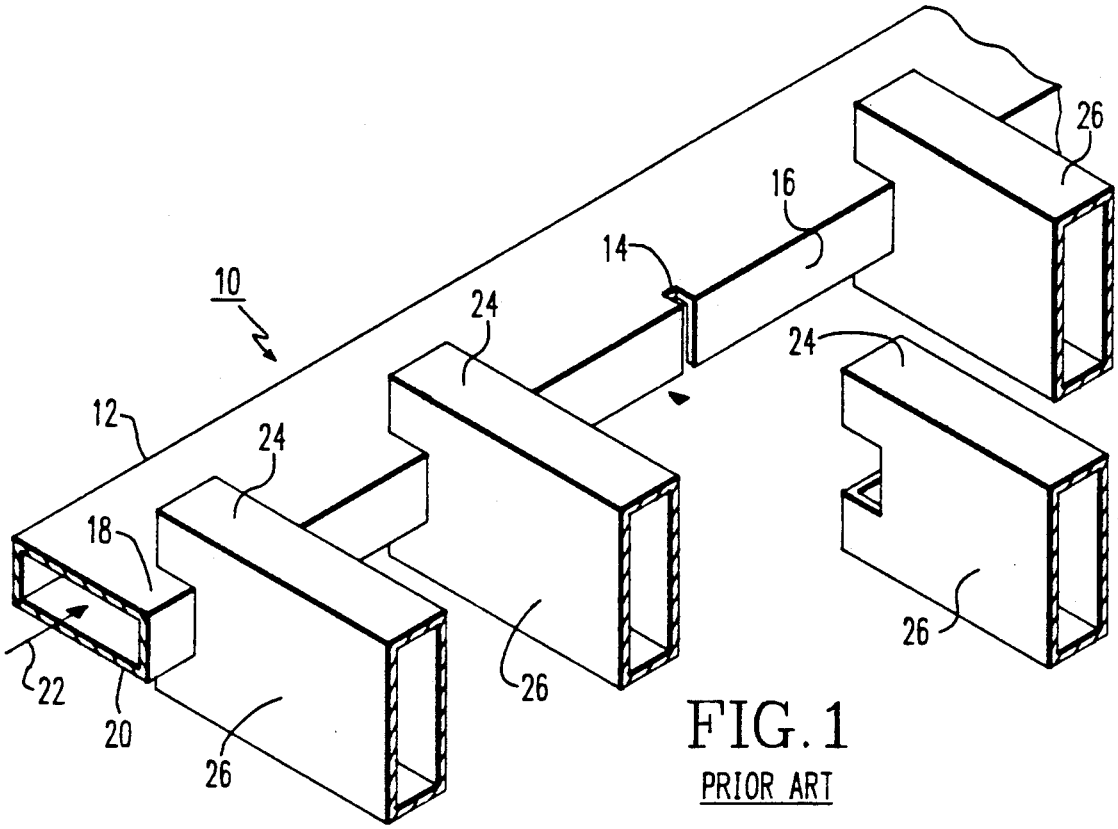
FIG. 1 PRIOR ART
FIG. 1 is a fragmented partially exploded perspective view of a known slotted waveguide power divider.
Figure 2:
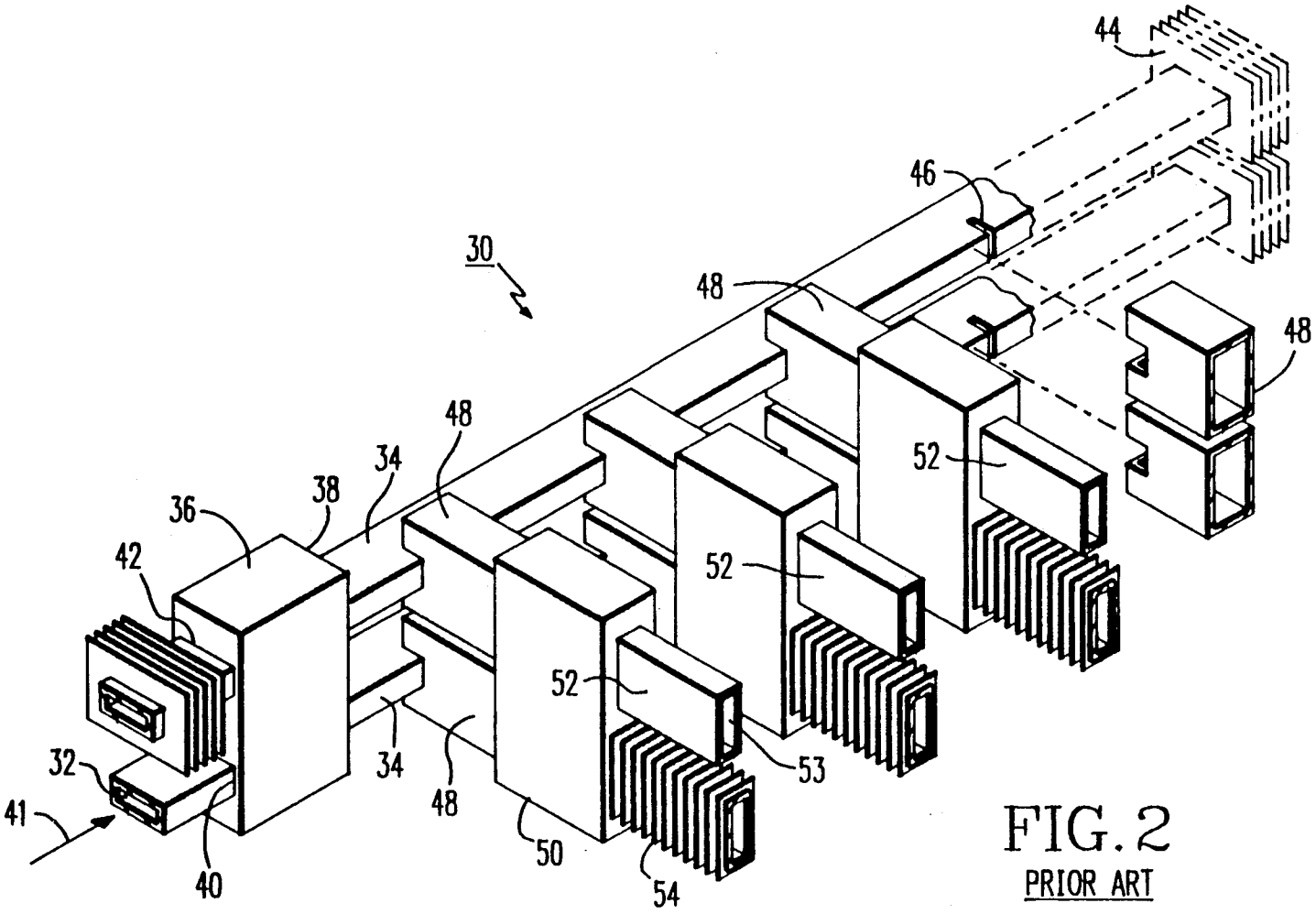
FIG. 2 PRIOR ART
FIG. 2 is a fragmented partially exploded perspective view of a known isolated slotted waveguide power divider.

In the arrangement illustrated, the jogs 84 are separated by a distance 110 equal to or greater than about one quarter wavelength or more of the anticipated input signal to thereby isolate each output stripline 90 (FIG.3). Other dimensions are similarly determined in terms of the wavelength of the signal. The terminal ends 112 of the various output striplines 90 form respective outputs (l)...(n) which are electrically independent. It is anticipated that the bandwidth of the arrangement illustrated in FIGS. 3–5 will be about one octave wider than the slotted waveguide divider illustrated in FIGS. 1–2.

While there has been described what at present is believed to be the preferred embodiment of the present invention, it will be apparent to those skilled in the art the various changes and notifications may made therein without departing from the invention, and is intended in the appended claims to cover all such modifications and changes that come within true spirit and scope of the invention.

What is claimed is:

1. A wideband stripline power divider for dividing an input signal comprising:

a trough having a longitudinal axis;

a pair of spaced apart meander input striplines for receiving the input signal thereon, said striplines located in said trough having jogs at which a corresponding divided portion of the input signal occurs, said striplines being in the form of conductors extending generally along spaced apart axes lying in a plane aligned with the axis of the trough, said jogs being in the form of portions of said conductors extending in a direction transverse to the axis of the trough, each jog for radiating the corresponding divided portion of the input signal;

a plurality of output striplines, a corresponding output stripline located in the vicinity of a corresponding jog and electrically responsive thereto, said output striplines lying in a plane perpendicular to the input striplines and aligned with the axis of the trough for receiving and carrying the corresponding divided portion of the input signal radiated at the corresponding jog; and a pair of opposed ground planes being coupled to the trough said output striplines being located between the ground planes, said group planes for confining the signal carried by each output stripline.

2. A wideband stripline divider adapted to divide an input signal coupled thereto comprising:

a pair of spaced apart meander input striplines for receiving such input signal, each meander stripline having lengthwise portions extending in a first direction for carrying the input signal and interconnecting jogs extending in a direction transverse to the lengthwise portions for radiating a corresponding divided portion of the input signal therefrom, said striplines lying in a plane;

opposed ground planes being interconnected with each other; and a plurality of output striplines lying between the ground planes in a plane between the input striplines and being perpendicular thereto, said output striplines each having a proximal end located near and electrically responsive to a corresponding jog in the input striplines for coupling the radiated corresponding divided portion of the input signal from the input striplines to each of the output striplines and a terminal end located remotely from the proximal end for producing an output signal corresponding to the divided portion of the input signal coupled thereto.

3. The divider of claim 2 wherein the striplines are arranged such that jogs in each stripline are adjacent each other and successive jogs extended alternatley towards and away from the plane of the output striplines.

4. The divider of claim 3, wherein the stripline includes a plurality of signal carrying portions and the jogs are located intermediate siad signal carrying portions, a first group of alternate ones of signal carrying portions in one of the striplines being closely spaced apart with respect to a corresponding group of signal carrying portions in another stripline and a second group of alternate ones of said signal carrying portions in the one stripline being remotely spaced apart from a corresponding group of signal carrying portions in the another stripline.

5. The divider of claim 2 further including terminating means coupled between the ground planes.

6. The divider of claim 5 wherein the terminating means comprises at least one conductive shunt coupled between the ground planes near the proximal ends of the output striplines.

7. The divider of claim 5 wherein the terminating means comprises an impedance coupled between the ground planes.

8. The divider of claim 2 wherein the pair of striplines is arranged such that the jogs in each stripline extend in a second direction.

9. A wideband stripline divider adapted to receive an input signal and provide a plurality of divided output signals comprising:

a pair of spaced apart meander input striplines lying in a plane for carrying such received input signal, each one of said mander striplines including an input portion, an output portion and an intermediate portion therebetween, each portion having ends and lying in end to end configuration in a first direction in the plane, and interconnecting jogs extending in a second direction transverse to the first direction for radiating a corresponding divided portion of such input signal from each of said jogs, one of said jogs connecting the input portion to the intermediate portion and another of said jogs interconnecting the intermediate portion with the output portion;

a pair of ground planes enclosing the input striplines; and a plurality of output striplines, one output stripline for each corresponding jog lying between the input striplines and being oriented perpendicular thereto, said output striplines for carrying the divided portion of the input signal radiated from the corresponding log, each output stripline having a proximal end in spaced relation with and being electrically responsive to the divided portion of the input signal radiated from the corresponding jog and a terminal end located remotely therefrom for producing divided output signals.

10. A wideband stripline divider for carrying a signal impressed thereon comprising:

a conductive trough having a longitudinal axis;

at least one meander stripline for receiving and carrying the signal and being located in the trough along the axis, said stripline including jogs extending in a direction transverse to the axis at which radiation corresponding to a divided portion of the signal occurs;

a plurality of output striplines, each output stripline having a proximal end located in the vicinity of and being electrically responsive to radiation at a corresponding jog and an output end remote therefrom, each of said output striplines for carrying the radiation produced by the corresponding jog to the output end thereof; and a pair of ground planes, the output striplines being located between the ground planes and being coupled to the trough for confining the radiation carried by output striplines.

* * * * *